US005924351A

United States Patent [19]

Kovatch

[11] Patent Number: 5,924,351

[45] Date of Patent: Jul. 20, 1999

[54] ADJUSTABLE CUT-OFF HEAD FOR A WIRE AND STRIP FORMING MACHINE

[75] Inventor: John Kovatch, North Lawrence, Ohio

[73] Assignee: Eaton Corporation, Cleveland, Ohio

[21] Appl. No.: 09/014,544

[22] Filed: Jan. 28, 1998

[51] Int. Cl.[6] ..... B26D 1/00

[52] U.S. Cl. ..... 83/699.41; 83/635; 83/640; 83/829

[58] Field of Search ..... 83/613, 627, 635, 83/640, 825, 829, 699.31, 699.41

[56] References Cited

U.S. PATENT DOCUMENTS

| | | | |
|---|---|---|---|
| 630,402 | 8/1899 | Parsons | 83/699.41 X |
| 681,811 | 9/1901 | Parsons | 83/699.41 X |
| 1,035,333 | 8/1912 | Felix | 83/627 X |
| 1,538,635 | 5/1925 | Hahn | 83/627 X |
| 1,559,083 | 10/1925 | Friederici | 83/627 X |
| 1,597,646 | 8/1926 | Ziegler | 83/613 X |
| 1,980,592 | 11/1934 | Nasmith et al. | 83/699.31 |
| 2,151,822 | 3/1939 | Winchester | 83/613 X |
| 2,379,740 | 7/1945 | Palmer | 83/699.31 X |
| 2,521,688 | 9/1950 | Cataldo et al. | 83/613 X |
| 3,198,051 | 8/1965 | Ablon | 83/640 X |
| 3,245,296 | 4/1966 | Valente | 83/635 X |
| 3,517,580 | 6/1970 | Sturm | 83/699.31 X |
| 3,593,610 | 7/1971 | Valente | 83/635 X |
| 3,623,388 | 11/1971 | Gottling | 83/699.31 X |
| 3,756,110 | 9/1973 | Von Arx | 83/640 X |
| 3,756,670 | 9/1973 | Harris | 83/635 X |
| 4,214,497 | 7/1980 | Dahms | 83/699.31 X |
| 4,246,819 | 1/1981 | Dahms | 83/640 X |
| 4,270,970 | 6/1981 | Szanto et al. | 156/477 B |
| 4,416,176 | 11/1983 | Forthmann | 83/699.3 X |
| 4,476,762 | 10/1984 | Anderson, III et al. | 83/640 |
| 4,479,376 | 10/1984 | Carlson et al. | 72/455 |
| 5,123,829 | 6/1992 | Eason et al. | 83/613 X |
| 5,174,187 | 12/1992 | Tintle | 83/699.41 X |
| 5,189,938 | 3/1993 | Tintle | 83/699.41 X |
| 5,236,489 | 8/1993 | Brancati et al. | 83/635 X |
| 5,265,502 | 11/1993 | Hoffa | 81/9.51 |
| 5,720,097 | 2/1998 | Randazzo et al. | 29/864.6 |
| 5,784,940 | 7/1998 | Gross et al. | 83/699.31 X |

*Primary Examiner*—M. Rachuba
*Attorney, Agent, or Firm*—Daniel S. Kalka; Albert E. Chrow

[57] ABSTRACT

Disclosed is a cut-off head (100) for a forming machine having a slot (21) across a bottom side of a stationary member (44) and a reciprocating member (16) that carries a cutting blade (60) that is operative to cut wire or strip passing through a guide member (56) that is releasably secured to stationary member (44) by a guide holding member (34) to enhance repairability and replacement. Slot (21) of cut-off head (100) is pivotably engageable with a portion of a positionable plate member (20) that is releasably secured to the stationary frame of the forming machine.

7 Claims, 3 Drawing Sheets

ADJUSTABLE CUT-OFF HEAD FOR A WIRE AND STRIP FORMING MACHINE

This invention relates to a cut-off head for cutting wire or strips exiting from a guide member such as utilized in apparatus operative to form fasteners and more particularly to an improved cut-off head having a positive stop in combination with means for adjusting its position in a direction generally parallel with the direction of movement of the wire or strip as well as having a releasably securable guide holding member to enhance the replacement or repairability thereof.

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

Forming machines have long been employed to form objects such as fasteners from wire or strip on a continuous high speed basis. One example of such a machine that has proven to be highly effective in forming objects including fasteners from wire or strip is described in U.S. Pat. No. 4,479,376 and is known in the forming industry as the "Nilson fourslide metal forming machine" in which wire or strip is indexed past successive forming stations at which the wire strip is bent or punched or other operations are performed by means of reciprocating tools and which, at some point, is cut to form separate objects such as fasteners by means of a reciprocating cutting blade mounted on a cut-off head.

Although cut-off heads provided with the Nilson fourslide forming machines have been found to be effective, the wire or strip guide holder used in connection therewith has heretofore been an integral part of the reciprocating member making repairs costly and difficult when wear or breakage occurs to the guide holder.

Although adjustable relative the frame to which they were secured, the prior art cut-off heads could not be moved in an incremental manner.

The present invention overcomes the above described shortcomings by providing a guide holder that is releasably securable to the end of the reciprocating member to which it is releasably secured as well as providing an adjustable plate member upon which the cut-off head is pivotably engageable to provide a positive stop preventing as well as providing movement of the stationary position of the cut-off head in the direction of reciprocation as a means for positioning the cut-off blade in a direction generally transverse to the direction of reciprocation.

BRIEF SUMMARY OF THE INVENTION

Accordingly, it is an object of this invention to provide a cut-off head for cutting wire or strip.

It is another object of this invention to provide a cut-off head employing a holder for a guide through which the wire or strip passes prior to being cut that is releasably secured to a reciprocating member thus lessening the cost and expense of repair or replacement.

It is yet another object of the present invention to provide a cut-off head having a reciprocating cut-off blade for cutting wire or strip that is pivotably engageable with a portion of a plate member that is adjustably positionable in a direction generally transverse to the direction of reciprocation as well as providing a positive stop to prevent movement of the stationary part of the cut-off head in a direction generally parallel to the direction of reciprocation.

DETAILED DESCRIPTION OF THE INVENTION

Figure 1:
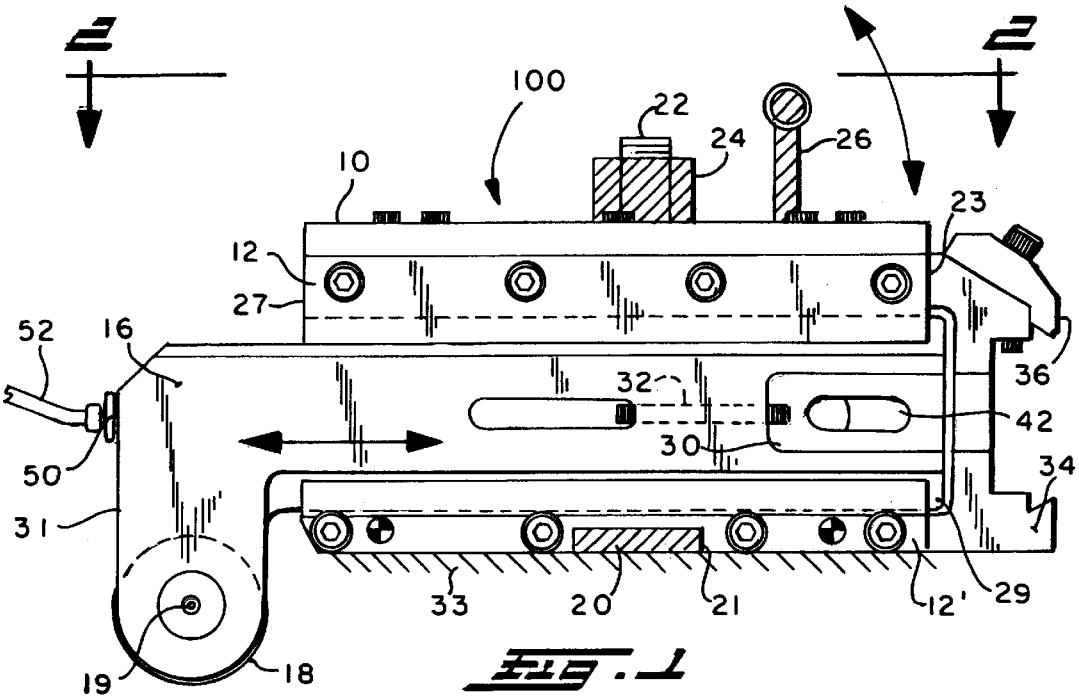
FIG. 1 is a side elevation view of an embodiment of the cut-off head of the invention referenced by numeral 100.
Figure 2:
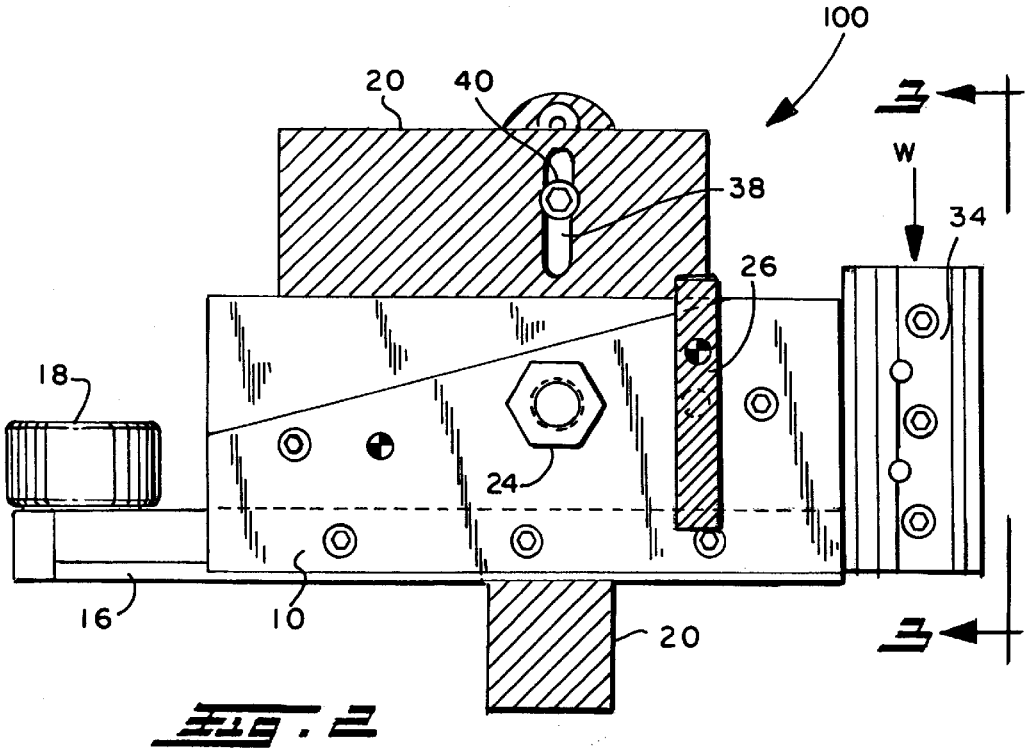
FIG. 2 is a top view of cut-off head 100 taken along view line 2—2 in FIG. 1.

In FIG. 1, cut-off head 100 has a first stationary member 44 (referenced in FIG. 3) having a first end 23 that is spaced-apart from an opposite second end 27.

Figure 3:
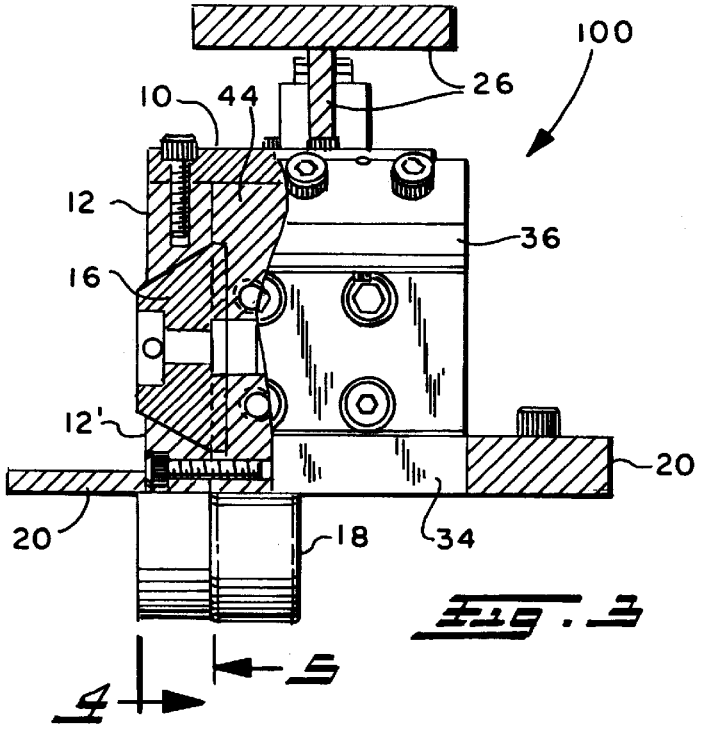
FIG. 3 is an end view of cut-off head 100 taken along view line 3—3 in FIG. 2.

A second reciprocating member 16 is secured in sliding reciprocal relationship to stationary member 44 by means of releasably secured side plates 12 and 12' shown in FIGS. 1 and 3. Reciprocating member 16 has a first end 29 correlating with first end 23 of member 44 and an opposite spaced-apart second end 31 correlating with second end 27 of member 44.

A cutting blade holder 30 having an elongate slot 42 is disposed adjacent first end 29 of member 16. A threaded screw 32 is provided for adjusting the position of a cutting blade generally parallel to the direction of reciprocation of member 16 that is secured at 30 to member 16 by means of a T bolt or the like extending through slot 42.

A roller follower 18 is disposed at second end 31 of member 16 that is engageable with a rotary cover guide track that upon rotation is adapted to cause member 16 to reciprocate in the direction of the arrows.

Stationary member 44 is provided with a top plate 10 through which a threaded bolt 22 extends having a nut 24 that when tightened against top 10 holds the various components of member 44 together.

A handle 26 also extends upwardly from member 44 to enable one to pivot cut-off head 100 about a pivot point as shown by the arrows.

A slot 21 extends across the side of member 44 facing towards fixed frame 33 in a direction generally transverse to the direction of reciprocation of member 16. Slot 21 registers with a portion of a plate 20 that is adjustably positionable with respect to frame 33 in the direction of reciprocation of member 16 by means of a bolt 40 or the like extending through an elongate slot 38 through plate 20. As such, a positive stop is provided for cut-off head 100 that is postionably adjustable in a direction generally transverse to the direction of reciprocation while preventing movement of member 44 in the direction of reciprocation of member 16.

A guide holding member 34 is releasably secured to first end 23 of stationary member 44. Member 34 includes a clamping member 36 that cooperates with member 34 to secure a guide member 56 (shown in FIG. 6) to guide holding member 34 by means of a wedging action.

Cut-off head 100 is preferably provided with an internal lubricating system operative to reduce friction between stationary member 44 and reciprocating member 16.

Figure 4:
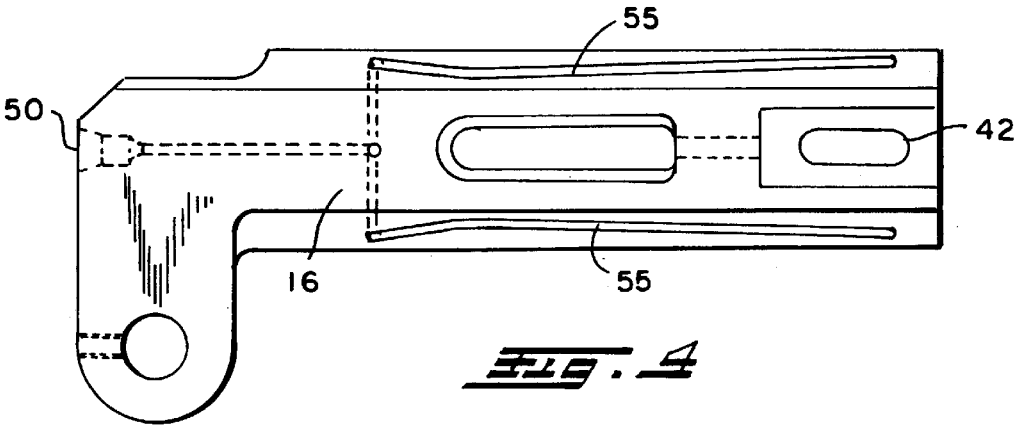
FIG. 4 is a side view of reciprocating member 16 of cut-off head 100 taken along view line 4 in FIG. 3.
Figure 5:
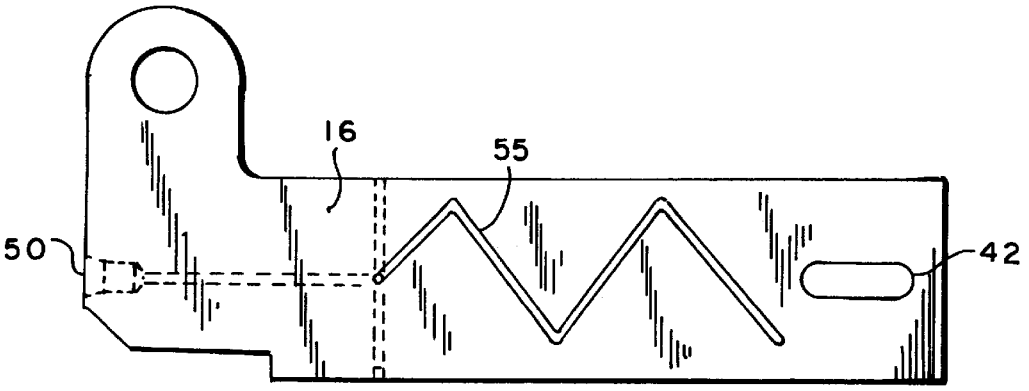
FIG. 5 is a side elevation view of reciprocating member 16 of cut-off head 100 taken along view line 5 in FIG. 3.
Figure 6:
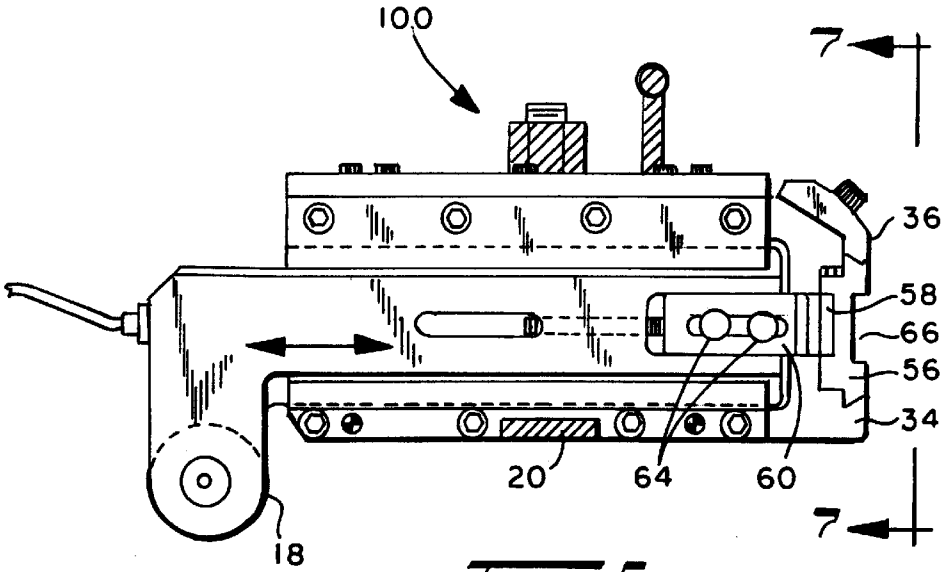
FIG. 6 is a side elevation view of cut-off head 100 of FIG. 1 having a cut-off blade 60 and a die 56 attached.

Although other lubricating systems may be employed, the lubricating system described in FIGS. 1, 4 and 5 is preferred for it eliminates all exterior connections except flexible inlet hose 52 attached to inlet fitting 50 at second end 31 of reciprocating member 16 which is operative to convey lubricating fluid into internal lubricant grooves 54 and 54' shown in FIG. 4 and to lubricant groove 55 on the opposite side of member 16 shown in FIG. 6. Grooves 54 and 54' are respectively disposed in the opposed tapered surfaces between member 16 and side plates 12 and 12' as shown in FIG. 3.

Figure 7:
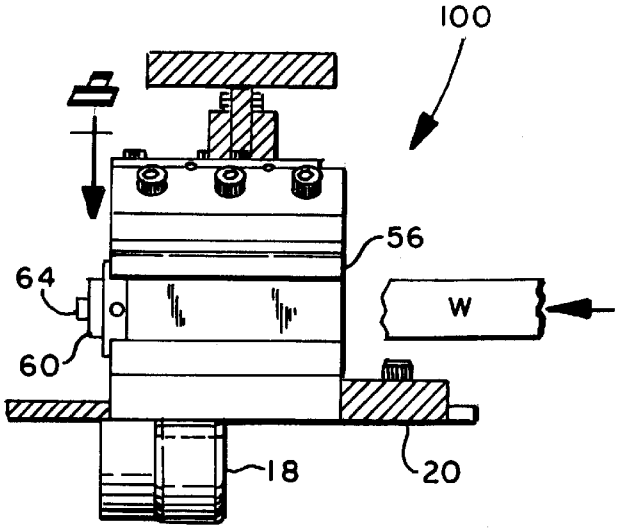
FIG. 7 is an end view of cut-off head 100 taken along view line 7—7 in FIG. 6.

Guide member 56 is provided with an opening in slot 58 through which a work piece such as a strip "W" passes in the direction indicated by the arrow in FIG. 7. Strip "W" is in the process of being formed for example into a fastener at other locations in the forming machine. Plate 20 is positionably secured to the stationary frame 33.

Figure 8:
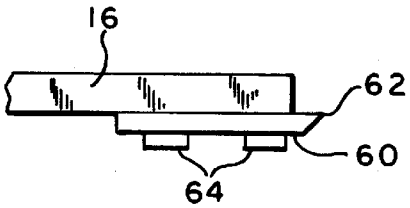
FIG. 8 is a partial top elevation view of a cutting blade 62 secured to reciprocating member 16 of cut-off head 100 of FIG. 1.

Opening 58 in guide plate 56 guides strip "W" into position for cutting by blade 60 having a cutting edge 62 shown in FIG. 8 and which is releasably secured adjacent first end 29 of reciprocating member 16 by means of one or more bolts or the like such as bolts 64 as earlier described.

Coordinated rotary cam actions associated with the forming machine move or index strip "W" a prescribed incremental distance past the left side of guide member 56 shown in FIG. 7, which is then cut in conjunction with coordinated reciprocal movement of cutting blade 60.

Guide member 56 preferably includes a clearance 66 across its side facing away from member 44 as shown in FIG. 6.

I claim:

1. An improved adjustable cut-off head for a wire and strip forming machine, comprising:

a first stationary member having spaced-apart first and second ends;

a second reciprocating member secured to the first stationary member in slidable reciprocal relationship relative to the first stationary member, said second reciprocating member having spaced-apart first and second ends corresponding to the first stationary member first and second ends, and said second reciprocating member having a cutting blade releasably secured to the first end thereof and having a roller follower disposed at the second end thereof constructed to be engageable with a rotary guide track, said roller follower being operative to move the second reciprocating member reciprocally relative the first stationary member in response to rotation thereof;

means for adjusting a position of the cutting blade in a direction corresponding to the reciprocal movement of the second reciprocating member;

a guide holding member releasably secured to the first stationary member first end; and a guide member releasably secured to the guide holding member, the guide member having an opening constructed to receive a workpiece and operative to guide the workpiece transversely past the cutting blade for cutting thereby upon exiting from the guide member in response to reciprocal movement of the cutting blade, the first stationary member having a slot extending in a direction generally transverse to a direction of reciprocation by the second reciprocating member, the slot in the first stationary member being on a side that is engageable with a portion of a plate member that is releasably secured to a stationary machine frame, the plate member having means for incrementally positioning the cut-off head in a generally transverse direction relative to the direction of reciprocation, the portion of the plate member engageable by the slot in the first stationary member preventing movement thereby in the direction of reciprocation of the second reciprocating member whilst adjustably positionable in a direction generally transverse to the direction of reciprocal movement of the second reciprocating member and said guide holding member being releasably securable to the first stationary member first end to facilitate the replacement and repairability thereof.

2. The cut-off head as recited in claim 1 wherein the guide member is releasably secured to the guide holding member by means for wedging the guide member to the guide holding member.

3. The cut-off head as recited in claim 2, wherein the wedging means comprises a clamping member cooperating with the guide holding member.

4. The cut-off head as recited in claim 1, wherein the means for incrementally positioning comprises an elongate slot in the plate member, and the plate member being secured to the stationary machine frame with a fastener.

5. The cut-off head as recited in claim 1, further comprising means for internally lubricating the cut-off head.

6. The cut-off head as recited in claim 5, wherein the means for internally lubricating comprises an inlet fitting attached to the second end of the second reciprocating member, the inlet fitting being constructed to receive and convey a lubricating fluid to internal lubricant grooves in opposed surfaces of the second reciprocating member.

7. The cut-off head as recited in claim 1, further comprising a handle attached to a side of the first stationary member opposite that of the side having the slot.

* * * * *